United States Patent [19]

Carson

[11] Patent Number: 4,479,189

[45] Date of Patent: Oct. 23, 1984

[54] UTILITY AND HYDROGEN CONSERVATION IN HYDROGEN RECYCLE PROCESSES

[75] Inventor: Don B. Carson, Mt. Prospect, Ill.

[73] Assignee: UOP Inc., Des Plaines, Ill.

[21] Appl. No.: 374,859

[22] Filed: Oct. 23, 1984

[51] Int. Cl.[3] ..... G06G 7/58

[52] U.S. Cl. ..... 364/500; 364/501; 364/502; 364/156; 208/DIG. 1

[58] Field of Search ..... 208/DIG. 1; 364/500, 364/501, 156, 172, 502

[56] References Cited

U.S. PATENT DOCUMENTS

| | | | |
|---|---|---|---|
| 3,814,915 | 6/1974 | Sweeney | 364/156 X |
| 3,814,916 | 6/1974 | Sweeney | 364/156 X |
| 3,972,804 | 8/1976 | McLaughlin et al. | 208/108 |
| 3,974,064 | 8/1976 | Bajek et al. | 208/134 |

OTHER PUBLICATIONS

Instrumentation Technology, "*Computer Control of Severity in Ethylene Cracking Furnaces*", R. A. Baxley, Jr., Nov. 1971.

"Optimizing Control of a Chemical Process", Control Engineering, pp. 197–204, Sep. 1957.

*Primary Examiner*—Charles E. Atkinson
*Assistant Examiner*—Allen MacDonald
*Attorney, Agent, or Firm*—William H. Page, II; John F. Spears, Jr.; Richard J. Cordovano

[57] ABSTRACT

There is disclosed a system for measuring and controlling the concentration of hydrogen in hydrogen-consuming hydrogen recycle processes used in oil refineries and petrochemical plants. The system is intended to reduce utilities and hydrogen usage by means of adjusting vent gas flow and the quantity of hydrogen and hydrocarbon vapor circulating to obtain the operating parameters which yield minimum cost. Specifically there can be a savings of compressor power, fuel required for heating, and hydrogen. The system is dependent on the recognition that a decrease in cooling medium temperature results in an increase in hydrogen flow, which can be decreased to the minimum permissible without endangering catalyst activity and stability and product yield if hydrogen concentration is monitored, that partial pressure is the key parameter, and that it is advantageous to optimize.

10 Claims, 1 Drawing Figure

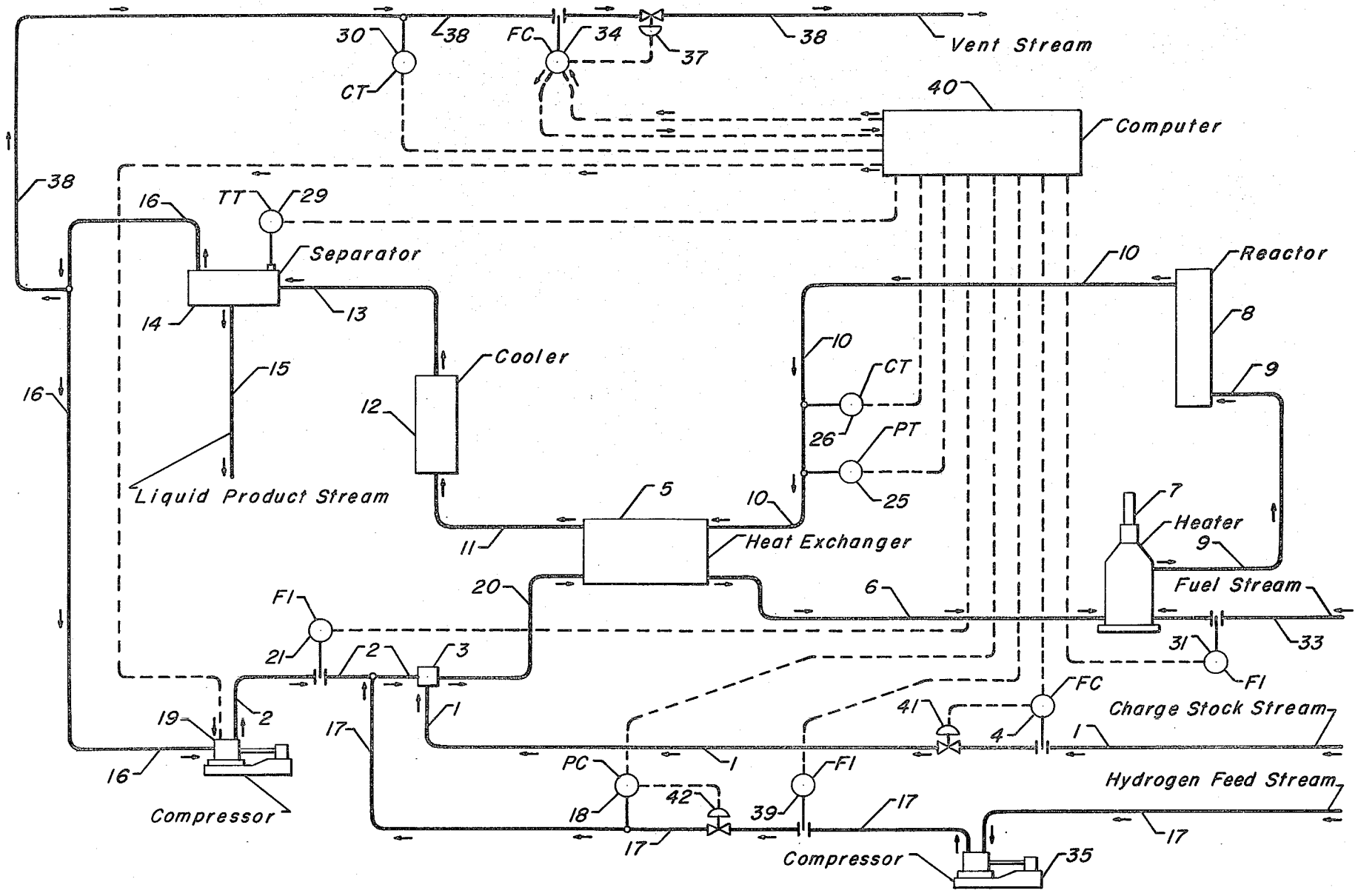
Reactor
Computer
Vent Stream
Heater
Fuel Stream
Charge Stock Stream
Hydrogen Feed Stream
Heat Exchanger
Cooler
Separator
Liquid Product Stream
Compressor
Compressor
FC
FI
PT
CT
TT
PC

UTILITY AND HYDROGEN CONSERVATION IN HYDROGEN RECYCLE PROCESSES

BACKGROUND OF THE INVENTION

This invention relates to conservation of utilities and hydrogen in hydrogen recycle processes used in oil refineries and petrochemical plants. More specifically, the invention relates to a method, applicable only to hydrogen-consuming hydrogen recycle processes, of adjusting hydrogen recycle flow and the amount of hydrogen vented in order to accomplish operation in which the cost of fuel, compressor power, and hydrogen, all taken together, is at a minimum. Hydrogen recycle processes can be classified into two types: those which produce hydrogen and those which consume hydrogen. Examples of hydrogen-producing processes are catalytic reforming and the various dehydrogenation processes. Hydrogen-consuming processes include hydrogenation, hydrodealkylation, hydrodesulfurization, hydrocracking, and isomerization. The Drawing, which is presented herein as an example, shows the basic flow arrangement of hydrogen-consuming hydrogen recycle processes. A circulating gas flow consisting mainly of hydrogen and including hydrocarbon vapors is maintained in the equipment loop by means of a compressor. A hydrocarbon charge stock stream and a hydrogen stream are added to the loop. A liquid product stream and a vent stream are removed from the loop. It is desirable to maintain the concentration of hydrogen in the reactor above a certain minimum value for each particular process in order to protect catalyst activity and stability and/or product yield structure. These minimum values are known to those skilled in the art by means of experimental data which has been collected by them. If the hydrogen concentration falls below the minimum value in a process where the reactor contains catalyst, the result will be excessive deposit of coke on the catalyst, premature deactivation of the catalyst, and reduction of product yield. In those processes which do not utilize a catalyst, the hydrogen concentration must be maintained above the minimum value in order to protect the yield structure; that is, to maximize the amount of desired product produced by the processing unit and minimize the production of undesirable by-products. A standard method for maintaining the required minimum hydrogen concentration is to control the rate at which gas is circulated by adjusting compressor capacity and to control vent gas flow. The operator of the hydrocarbon processing unit monitors the quantity of circulating gas flowing by means of a flow indicator and manually adjusts compressor capacity. Alternatively, an automatic flow controller can be used to maintain the quantity flowing at an appropriate value above the minimum. An automatic flow control loop is used to control the vent flow at a previously determined value. The vent flow is made necessary by the presence of light hydrocarbons in the circulating gas stream. Some light hydrocarbons enter the system as part of the hydrogen feed stream, which is not pure hydrogen, and some are produced in side reactions taking place in the reactor. While some of the light hydrocarbons leave the system dissolved in the liquid product stream, there is usually an increase in concentration over time unless a vent stream is employed. Thus the purpose of the vent stream is to remove light hydrocarbons from the process, as they would interfere with the desired reactions. The principle is similar to that of cooling tower blowdown, where a continuous stream of water is withdrawn to keep water hardness at an acceptably low level. The vent stream usually contains 60 mole percent or more of hydrogen, so there is a significant hydrogen loss from the system. The vented gas is usually routed to the refinery fuel gas system. However, hydrogen has more value in the process than it does as fuel, so it is economically desirable to reduce the amount vented. Vent gas flow and circulating gas flow are not the variables which it is necessary to control, thus the desired flow values must be set higher than necessary to ensure the existence of an adequate safety margin for hydrogen content of the circulating gas flow.

In addition, variations in cooling efficiency lead to an excessive circulating gas flow. The cooling medium used in the cooler, which is part of the equipment loop shown in FIG. 1, is water or ambient air. The temperature of the cooling medium varies with weather conditions and time of day and can vary from hour to hour. As the cooling medium temperature falls, a larger quantity of hydrocarbon vapor condenses out of the cooled stream, thus causing the concentration of hydrogen in the circulating stream to increase. The average molecular weight of the circulating gas stream decreases as hydrogen concentration increases. The flow meter used is normally of the orifice type. As can be seen from an inspection of the well-known orifice flow meter equation and the example presented herein, a lower molecular weight of the circulating gas stream results in a lower flow reading, which is false. This lower flow reading causes the operator or automatic controller to increase compressor capacity or output in order to bring the flow reading back up to its proper value. However, the flow reading is not an accurate indication of hydrogen concentration, because of the changed molecular weight, and the effect is an increase in circulating gas flow which is not necessary to protect the catalyst and does not serve any other desired purpose. Even though a decrease in cooling medium temperature causes an increase in hydrogen concentration, in the absence of instrumentation to show this, it is not possible to act on the decrease, and in fact, it is necessary to adjust the compressor to raise the flow rate back to its former value in order to ensure protection of the catalyst and yield structure. Thus a decrease in the temperature of a cooling medium which is capable of varying from hour to hour results in an unnecessarily large circulating gas flow. The excess circulating gas must be heated and compressed. Reducing the circulating gas flow will result in a decrease in utility usage required to accomplish this. Variations in cooling efficiency also lead to an excessive loss of hydrogen by means of the same basic mechanism that causes an excessive circulating gas flow, i.e., a false decrease in vent flow indication due to lower average molecular weight. A decrease in cooling medium temperature causes the flow indication at the vent stream to decrease and therefore the automatic controller opens the vent valve wider, discharging more hydrogen from the process, the vent stream being hydrogen-rich. It is possible to control circulating gas composition at a constant value by regulating the quantity of cooling medium passed through the cooler. However, this is not usually a desirable option, since a colder cooling medium yields a colder gas-liquid separator, which enhances liquid product recovery and the purity of the circulating gas. Also, a colder gas-liquid separator results in less hydrogen being dissolved in the liquid product stream and therefore lost from the system.

The art which has been discovered which is closest to the instant invention is disclosed by Bajek and McLaughlin in U.S. Pat Nos. 3,974,064 and 3,972,804. These patents present a comprehensive control scheme for hydrogen recycle processes. The instant invention can be considered an improvement on those inventions. Those effects of changes in cooling medium temperature which are adverse are recognized and control action is taken to mitigate them. The key process parameter of partial pressure is recognized and used to initiate control action. An excessively large safety margin in hydrogen concentration is not necessary. While every process can be optimized, it has been discovered that it is worthwhile to utilize a mathematical optimization procedure in the circumstances described herein, as the optimum is not at the point which appears to be obvious from inspection of the procedure.

BRIEF SUMMARY OF THE INVENTION

It is an object of this invention to provide a means of reducing utility usage in hydrogen recycle processes by reducing the amount of gas which must be circulated and thereby reducing energy required to heat and compress the circulating gas. It is a further object to provide a means of reducing the amount of hydrogen vented from hydrogen-consuming hydrogen recycle processes. The concentration of hydrogen is obtained and used to adjust the output of the compressor and the vent gas flow rate so that the concentration of hydrogen is at the minimum required to protect the catalyst and/or maintain the yield structure and the costs involved in venting hydrogen and heating and compressing the circulating gas are minimized.

In one of its broad aspects, the present invention embodies a method of using lesser quantities of utilities and hydrogen, consisting of (a) providing the concentration of hydrogen in said hydrocarbon processing unit to computer means; (b) comparing, in said computer means, said concentration of hydrogen to a previously established value; (c) providing necessary process measurements from said processing unit to said computer means; (d) calculating in said computer means the values of compressor output and vent gas flow which satisfy the conditions that said hydrogen concentration is equal to said previously established variable and that said unit is operating at a minimum cost, said cost being based on (i) fuel supplied to said heater means, (ii) power supplied to said compressor means, (iii) the quantity of hydrogen supplied to said processing unit minus a credit for hydrogen removed from said processing unit in said vent gas stream; (e) adjusting compressor output and vent gas flow to the calculated values; and (f) continuously repeating steps (a) through (d) as process measurements used in said calculation vary. In a more specific embodiment of the present invention, the concentration of hydrogen in the reactor is expressed in terms of partial pressure and is obtained by means of measuring the total pressure of the feed stream, measuring the mole fraction of hydrogen in the feed stream, then multiplying mole fraction times total pressure, the product being partial pressure. Other objects and embodiments will become apparent upon consideration of this entire specification.

BRIEF DESCRIPTION OF DRAWING

The drawing, which is presented herein as an example, depicts a typical flow scheme for hydrogen-consuming hydrogen recycle processes.

DETAILED DESCRIPTION OF THE INVENTION

The Drawing depicts a typical flow scheme for hydrogen-consuming hydrogen recycle processes used in oil refineries and petrochemical plants and a mode of practicing the invention wherein the partial pressure of hydrogen is calculated from measurements of total pressure and mole fraction. Note that the dashed lines represent transmission of control signals to and from items of control hardware and that solid lines drawn to the circles representing instruments denote pipelines containing process fluid. The further description of this invention is presented with reference to the schematic Drawing. The Drawing is not intended as an undue limitation on the generally broad scope of the invention as set out in the claims. Only those compressors, heaters, heat exchangers, and coolers are shown that are useful in the description of the process. The depiction of other miscellaneous hardware such as pumps, instrumentation and controls, and valves has been omitted as not essential to a clear understanding of the process, the use of such hardware being well within the purview of one skilled in the art. Each of the equipment items shown in the Drawing may consist of several individual pieces of equipment. For example, reactor 8 may consist of a single vessel or may consist of several reaction vessels with provisions to reheat the process stream between vessels. Also, equipment may be added to this basic flow scheme. For example, the circulating gas stream may be passed through equipment designed to remove hydrogen sulfide. These variations and additions to the basic simple schematic are well known to those skilled in the art of hydrocarbon processing.

In the Drawing, a charge stock stream enters the processing unit through pipeline 1 and is mixed with circulating gas flowing in pipeline 2 by means of mixing pipeline section 3 to form a reactor feed stream in pipeline 20. The rate of charge stock addition is controlled at a particular preset value by flow controller 4 and flow control valve 41. The circulating gas stream flowing in pipeline 2 consists mainly of hydrogen but includes hydrocarbon vapors. The reactor feed stream flows through pipeline 20 to regenerative heat exchanger 5, where it is heated, and then through pipeline 6 to heater 7. The feed stream is heated further in heater 7 and then flows through pipeline 9 to reactor 8, where the desired reactions take place. The effluent stream produced in reactor 8 flows through pipeline 10 to regenerative heat exchanger 5 where it is cooled by giving up its heat to the reactor feed stream. From regenerative heat exchanger 5, the product stream flows through pipeline 11 to cooler 12 where it is further cooled by means of a cooling medium which is water or ambient air. As a result of this cooling, liquid hydrocarbons are condensed. The effluent stream flows from cooler 12 through pipeline 13 to gas-liquid separator 14 where it separates into two streams—a liquid product stream which flows out of the hydrocarbon processing unit through pipeline 15 and a hydrogen and hydrocarbon vapor stream, a portion of which flows through pipeline 16 to compressor 19. Pipeline 17 is connected to pipeline 2 and is used to supply hydrogen to the hydrocarbon processing unit from a source outside of the unit. Pressure controller 18 and pressure control valve 42 regulate the addition of hydrogen so that a constant preset pressure will be maintained at the suction of compressor 19. As hydrogen is consumed in the reactor, the pressure decreases, causing the valve to open to allow hydrogen to flow into the hydrocarbon processing unit. Flow indicator 39 provides a measurement of the flow rate of hydrogen supplied to the unit. Compressor 35 increases the pressure of the feed stream so that a sufficient flow rate into pipeline 2 can be maintained. Flow indicator 21 provides a measurement of gas flow at the outlet of compressor 19; however, it is accurate at only one particular set of operating conditions, as explained earlier. Fuel which is burned in heater 7 in order to heat the reactor feed stream is supplied through pipeline 33, with the quantity flowing being measured by flow indicator 31. Hydrogen and hydrocarbon vapor flow out of the hydrocarbon processing unit through pipeline 38. The flow is controlled by flow control valve 37 and flow controller 34. The vent flow is made necessary by the presence of light hydrocarbons in the circulating gas stream. Some light hydrocarbons enter the system through pipeline 17 as part of the hydrogen feed stream, which is not pure hydrogen, and some are produced in side reactions taking place in reactor 8. While some of the light hydrocarbons leave the system dissolved in the liquid product stream, there is usually an increase in concentration over time unless a vent stream is employed. Thus the purpose of the vent stream is to remove light hydrocarbons from the process, as they would interfere with the desired reactions. The principle is similar to that of cooling tower blow-down, where a continuous stream of water is withdrawn to keep water hardness at an acceptably low level. The vent stream usually contains 60 mole percent or more of hydrogen.

The Drawing shows the instrumentation necessary to practice an embodiment of the invention. Hydrogen concentration can be expressed as partial pressure of hydrogen. The pressure in pipeline 10 is sensed by a conventional pressure transmitter 25. The mole fraction of hydrogen in pipeline 10 is sensed by concentration transmitter 26, which may be a conventional thermal conductivity analyzer such as the 7C series sold by Beckman Instruments, Inc. The product of pressure times mole fraction, which is partial pressure, is obtained in computer 40. Alternately, hydrogen partial pressure can be sensed by an apparatus such as that disclosed by H. A. Hulsberg in U.S. Pat. Nos. 2,671,336 and 2,671,337 and transmitted to computer 40 by a conventional pressure transmitter. If computer 40 is used simply as a replacement for conventional automatic controllers, it is necessary to choose one final control element to be manipulated based on the partial pressure of hydrogen. If the final control element chosen were compressor 19, the amount of hydrogen circulated would be limited to the quantity required to meet the minimum necessary to protect the catalyst and/or maintain the yield structure. By means of reducing gas flow, the power needed by the driving means for compressor 19 and the quantity of fuel burned to provide heat at heater 7 would be reduced. Compressor output is changed by adjusting the speed of the compressor or by adjusting inlet guide vanes. If the final control element chosen for manipulation were flow control valve 37, the control signal from computer 40 would actually be used to adjust the set point of flow controller 34, which would then supply a control signal to flow control valve 37. This is nothing more than a conventional application of cascade control in order to curb excessive fluctuation of system parameters. If flow controller 34 were chosen for manipulation, when the partial pressure of hydrogen is higher than required, the vent gas flow is decreased, thus conserving hydrogen and reducing the concentration of hydrogen in the circulating gas stream by operation of two mechanisms: an increase in the light hydrocarbon concentration due to decreased removal and a decrease in hydrogen flow to the unit due to the operation of pressure controller 18 and pressure control valve 42. Thus only the amount of hydrogen would be vented that would be required to meet the minimum necessary to protect the catalyst and/or maintain the yield structure. As detailed earlier, it is the fluctuation in cooling medium temperature which results in the opportunity to reduce utilities and hydrogen usage. The choice of which final control element to manipulate can be clearly determined by comparing the costs of fuel, compressor power, and hydrogen with all placed on an equalized basis. It is no longer necessary to accept the limitations of conventional automatic controllers and it is possible to manipulate both variables if a suitable control algorithm which is useful can be developed for use in a control computer.

The following example will be useful to illuminate the invention. The following Table presents certain operating parameters for a hydrogen-consuming hydrogen recycle process, more specifically a vacuum gas oil hydrotreater processing 45,000 barrels per day of vacuum gas oil. The Drawing can be used to represent a schematic of this example.

| | CASE A | CASE B | CASE C | CASE D |
|---|---|---|---|---|
| Separator Temperature, °F. | 150 | 125 | 125 | 125 |
| Hydrogen Feed, lb-mol/hr | 2,235.52 | 2,241.82 | 2,171.64 | 2,072.79 |
| Hydrogen Feed, $10^6$ SCFD | 20.36 | 20.42 | 19.78 | 18.88 |
| Vent Orifice DP, inches water | 42 | 42 | 24.85 | 7.8 |
| Vent Gas Rate, lb-mol/hr | 299.90 | 306.98 | 232.74 | 126.84 |
| Vent Hydrogen Rate, lb-mol/hr | 263.51 | 272.48 | 204.79 | 109.80 |
| Vent Hydrogen Rate, $10^6$ SCFD | 2.4 | 2.48 | 1.865 | 1.0 |
| Circulating Orifice DP, inches water | 42 | 42 | 42 | 63.8 |
| Circulating Gas Rate, lb-mol/hr | 5,813.67 | 5,936.11 | 5,864.06 | 7,042.49 |
| Circulating Hydrogen, lb-mol/hr | 5,108.23 | 5,269.02 | 5,159.79 | 6,096.43 |
| Circulating Hydrogen, $10^6$ SCFD | 46.52 | 47.99 | 46.99 | 55.52 |
| Circulating Gas Mol. Wt. | 4.02 | 3.84 | 3.95 | 4.16 |
| Gas to Reactor, lb-mol/hr | 8,049.18 | 8,177.93 | 8,035.70 | 9,115.27 |
| Hydrogen to Reactor, lb-mol/hr | 7,276.68 | 7,443.59 | 7,266.28 | 8,106.63 |
| Gas to Reactor, lb/hr | 28,812 | 28,238 | 28,461 | 34,341 |
| Hydrogen Partial Pressure, psia | 623 | 632 | 623 | 623 |
| Compression Load, hp | BASE | +19 | −43 | +51 |
| Equiv. Comp. Load, $10^6$ BTU/hr | BASE | +0.142 | −0.32 | +0.38 |

-continued

| | CASE A | CASE B | CASE C | CASE D |
|---|---|---|---|---|
| Heating Load × 1/0.85, $10^6$ BTU/hr | BASE | +0.129 | −0.08 | +3.12 |
| Equiv. Feed Gas Load, $10^6$ BTU/hr | BASE | +1.11 | −10.73 | −27.5 |
| Equiv. Vent Gas Load, $10^6$ BTU/hr | BASE | +1.07 | −7.17 | −18.8 |
| Total Equiv. Load, $10^6$ BTU/hr | BASE | +0.31 | −3.96 | −5.20 |

Note that the hydrogen feed stream is 97% hydrogen and not all the feed is vaporized before reaching the reactor. In the example, the concept of equivalent load is used to place the variables on an equalized basis for comparison. The relationship chosen is:

$$\text{Equivalent Total Load} = 1/0.85 \times FUEL + 0.007457 \times HP + 18.5 \times FEED\ GAS - 13.4 \times VENT\ GAS$$

The Drawing is used in explaining this equation. Equivalent total load is expressed in $10^6$ BTU/hr. FUEL is the product of the heating value of the fuel stream fed to heater 7 through pipeline 33 times the flow rate measured by flow indicator 31. The factor of 0.85 is used to account for the efficiency of heater 7. Alternatively, temperature differential across cooler 12 could be used to derive FUEL, on the basis that heat in equals heat out, assuming constant charge stock and hydrogen feed temperatures. HP is the horsepower requirement of compressor 19 and compressor 35, assuming they are electrically driven. The factor associated with HP is based on the assumption that an electric utility must fire 10,000 BTU in order to deliver one kilowatt-hour. Computer 40 can calculate HP given individual compressor characterization curves, flows as determined by flow indicator 39 and flow indicator 21, and pressure as determined by pressure controller 18. There are other groups of parameters which can also be used to calculate HP. FEED GAS is the quantity of hydrogen-rich gas as measured by flow indicator 39, expressed in $10^6$ SCFD. The factor 18.5 is used in this example to express the value of hydrogen in this particular refinery or petrochemical plant. VENT GAS is the quantity of hydrogen flowing out of the processing unit through pipeline 38 expressed in $10^6$ SCFD and is calculated in the computer based on the total gas flow measured by flow controller 34 and the concentration of hydrogen as measured by concentration transmitter 30, which may be the same type of instrument as concentration transmitter 26. The vent stream is normally burned as fuel gas and the factor 13.4 is used to express its value in the refinery or petrochemical plant of the example. Case A shows parameters when the unit is operating at design conditions, including the design maximum cooling medium temperature, at which the gas-liquid separator temperature will be 150° F. Temperature transmitter 29 provides the temperature at gas-liquid separator 14. Orifice DP refers to the pressure drops across the orifice plates used in the vent stream and circulating gas stream, the significance of which is explained earlier. The circulating gas parameters are taken at the outlet of compressor 19. Case B shows the parameters when the cooling medium temperature is such that gas-liquid separator 14 is operating at 125° F. and the plant is operated in a conventional manner. Note that the orifice DP in the circulating gas stream and in the vent gas stream are maintained at the same values and that the total equivalent load has increased. This increase is a result of the change in separator temperature. Case C shows the result when separator temperature is the same as in Case B but hydrogen partial pressure is used to control vent gas flow. Figures for the alternative mentioned above, where hydrogen partial pressure is used to control compressor output, are not presented as Case C is clearly more advantageous in the particular example chosen. It would appear that Case C represents an optimum, that is, the minimum equivalent total load which can be achieved. This can be seen by noting that loss of hydrogen through the vent is controlled at the minimum, thus the hydrogen feed stream must be at minimum flow rate, and that the heating load and compression load are both less than in the base case and in Case B. It has been discovered however, that it is advantageous to follow an optimization procedure. That process parameters can be optimized to yield a minimum cost case is not new, but that it would be advantageous to attempt optimization in this case is a new discovery. Case D shows the result when the invention is practiced using the particular relationships presented herein. The computer is used to calculate the equivalent total load at the various combinations of vent gas flow and circulating gas flow which are possible while maintaining hydrogen partial pressure at a minimum. A plot of these calculations, showing equivalent total load as the ordinate and vent gas flow or circulating gas flow as the abscissa is a U-shaped curve, with Case D representing the minimum equivalent total load. Whenever the separator temperature changes, a new minimum equivalent total load must be calculated and vent gas flow compressor output adjusted so that the processing unit operates at that minimum.

Each hydrogen-consuming hydrogen recycle process, each processing unit, and each refinery or petrochemical plant is unique, so the values of utilities, feed hydrogen, and vent hydrogen must be determined in each case along with their interrelationship. However, in every case it will be advantageous to implement an on-line mathematical method of optimization so that the minimum operating cost may be realized as described herein. To better illuminate the potential cost savings of the invention, in the example presented, consider that the difference between Case D and Case B can be realized, on the average, for 330 days per year. Using a realistic 1981 value of $5.00 per million BTUs, the cost savings in the unit of the example will be $218,000/year.

In the case of processes which consume a substantial amount of hydrogen, it is desirable to locate the sensing point to obtain closer control of hydrogen concentration. Since the reaction consumes hydrogen, the hydrogen concentration will decrease from the inlet to the outlet of the reactor means. The point of lowest hydrogen concentration will be at the outlet of the reactor means, i.e., in the reactor effluent stream. In contrast, in a hydrogen-producing process, the point of lowest hydrogen concentration will be at the entrance to the reactor means. The hydrogen concentration should be measured at the point where it is expected to be lowest in order to achieve the goal of maintaining as low as possible a concentration in order to conserve utilities while still protecting the catalyst and/or yield structure.

In some cases, it may be desirable to vary the location of the hydrogen concentration sensor. The sensor can be located in pipeline 11, rather than in pipeline 10. The reason for changing sensor location would normally be to expose it to less severe conditions. The considerations involved in choice of sensor location are familiar to those skilled in the art. For example, it must not be placed in pipeline 11 if liquid drops condense out in heat exchanger 5.

It is important to note that partial pressure is the parameter most relevant to protection of catalyst and yield structure. The invention can be practiced using any convenient method of measuring hydrogen concentration. However, for maximum precision, concentration of hydrogen should be expressed in terms of partial pressure. In the context of this invention, partial pressure is considered to be a form of expression of concentration. Often, the concentration of hydrogen can be measured by any convenient means without any loss of precision, since system pressure is relatively constant. But mole fraction, volume percent, and the like, do not completely correlate with improvement of catalyst activity and stability and yield. Pressure must be taken into account. If the amount of hydrogen in the circulating gas stream is held constant and the pressure is increased, the partial pressure of hydrogen increases. Catalyst activity and stability and yield will be improved by the pressure increase, though percent hydrogen has not changed.

I claim as my invention:

1. In a hydrocarbon processing unit controlled by computer means and means for monitoring process variables, said unit comprising heater means, reactor means, cooler means, gas-liquid separator means, and compressor means, wherein a charge stock stream comprising hydrocarbons is combined with a recycle stream comprising hydrogen and hydrocarbon vapors to form a feed stream which is heated in said heater means and then charged to said reactor means, wherein an effluent stream from said reactor means is cooled in said cooler means so that it is separated into a liquid product stream and a hydrogen and hydrocarbon vapor stream in said gas-liquid separator means, wherein at least a portion of said hydrogen and hydrocarbon vapor stream is recycled through said compressor means to said heater means and reactor means to serve as a portion of said feed stream, wherein a vent gas stream consisting of a portion of said hydrogen and hydrocarbon vapor stream is removed from said hydrocarbon processing unit, wherein it is desirable to maintain the hydrogen concentration in said reactor means at or above a certain minimum value, a method of using the lesser quantities of utilities and hydrogen, which method comprises the following steps:

(a) providing the concentration of hydrogen in said hydrocarbon processing unit to said computer means;

(b) comparing, in said computer means, said concentration of hydrogen to a previously established value;

(c) providing monitored process variables from said processing unit to said computer means;

(d) calculating in said computer means the values of compressor output and vent gas flow which satisfy the conditions that said hydrogen concentration is equal to said previously established value and that said unit is operating at a minimum cost, said cost being based on:

(i) fuel supplied to said heater means, (ii) power supplied to said compressor means, (iii) the quantity of hydrogen supplied to said processing unit minus a credit for hydrogen removed from said processing unit in said vent gas stream;

(e) adjusting compressor output and vent gas flow to the calculated values; and, (f) continuously repeating steps (a) through (e) as process measurements used in said calculation vary.

2. The method of claim 1 further characterized with respect to step (a) in that the concentration of hydrogen in said processing unit is expressed in terms of partial pressure.

3. The method of claim 1 further characterized with respect to step (a) in that the concentration of hydrogen in said hydrocarbon processing unit is obtained by means of an apparatus which directly measures partial pressure.

4. The method of claim 1 further characterized with respect to step (a) in that the concentration of hydrogen in said hydrocarbon processing unit is obtained by means of measuring the total pressure of said feed stream, measuring the mole fraction of hydrogen in said feed stream, then multiplying mole fraction times total pressure, the product being partial pressure.

5. The method of claim 1 further characterized in that said hydrocarbon processing unit is a hydrogenation unit.

6. The method of claim 1 further characterized in that said hydrocarbon processing unit is a hydrodealkylation unit.

7. The method of claim 1 further characterized in that said hydrocarbon processing unit is a hydrodesulfurization unit.

8. The method of claim 1 further characterized in that said hydrocarbon processing unit is a hydrocracking unit.

9. The method of claim 1 further characterized in that said hydrocarbon processing unit is an isomerization unit.

10. In a hydrocarbon processing unit comprising computer means heater means, reactor means, cooler means, gas-liquid separator means, and compressor means, wherein a charge stock stream comprising hydrocarbons is combined with a recycle stream comprising hydrogen and hydrocarbon vapors to form a feed stream which is heated in said heater means and then charged to said reactor means, wherein an effluent stream from said reactor means is cooled in said cooler means so that it is separated into a liquid product stream and a hydrogen and hydrocarbon vapor stream in said gas-liquid separator means, wherein at least a portion of said hydrogen and hydrocarbon vapor stream is recycled through said compressor means to said heater means and reactor means to serve as a portion of said feed stream, wherein a vent gas stream consisting of a portion of said hydrogen and hydrocarbon vapor stream is removed from said hydrocarbon processing unit, wherein it is desirable to maintain the hydrogen concentration in said reactor means at or above a certain minimum value, a control system for using lesser quantities of utilities and hydrogen in the operation of said hydrocarbon processing unit comprising, in cooperative combination:

(a) means for monitoring process variables in said hydrocarbon processing unit and providing signals representative of said variables to said computer means;

(b) said computer means for continuously calculating the values of compressor output and vent gas flow which satisfy conditions that said hydrogen concentration is equal to a previously established variable and that said unit is operating at minimum cost, said cost being based upon:

(i) fuel supplied to said heater means, (ii) power supplied to said compressor means, (iii) the quantity of hydrogen supplied to said processing unit minus a credit for hydrogen removed from said processing unit in said vent gas stream;

(c) means for adjusting compressor output and vent gas flow to the calculated values.

* * * * *

UNITED STATES PATENT AND TRADEMARK OFFICE

CERTIFICATE OF CORRECTION

PATENT NO. : 4,479,189

DATED : October 23, 1984

INVENTOR(S) : Don B. Carson

It is certified that error appears in the above-identified patent and that said Letters Patent is hereby corrected as shown below:

Title page:

Item [22] on the face of the patent, change the filing date from "October 23, 1984" to --May 4, 1982--.

Signed and Sealed this

*Second* Day of *April 1985*

[SEAL]

*Attest:*

DONALD J. QUIGG

*Attesting Officer*

*Acting Commissioner of Patents and Trademarks*